US006329584B1

(12) United States Patent
Liao

(10) Patent No.: US 6,329,584 B1
(45) Date of Patent: Dec. 11, 2001

(54) CHANGEABLE FOOT STRUCTURE FOR HI-HAT CYMBAL

(76) Inventor: Tsun-Chi Liao, No. 14, Chun-Kung Rd., Pei-Tun Dist., Taichung (TW)

( * ) Notice: Subject to any disclaimer, the term of this patent is extended or adjusted under 35 U.S.C. 154(b) by 0 days.

(21) Appl. No.: 09/736,213

(22) Filed: Dec. 15, 2000

(51) Int. Cl.[7] ..... G10D 13/02
(52) U.S. Cl. ..... 84/422.3; 84/422.2; 84/422.1
(58) Field of Search ..... 284/422.3, 422.1, 284/422.2

(56) References Cited

U.S. PATENT DOCUMENTS 5,018,426 * 5/1991 Suzuki ..... 84/422.3
5,028,776 * 7/1991 Forti et al. ..... 250/229
5,251,528 * 10/1993 Kurosaki ..... 84/422.3

* cited by examiner

*Primary Examiner*—Shih-Yung Hsieh
(74) *Attorney, Agent, or Firm*—Bacon & Thomas, PLLC

(57) ABSTRACT

A changeable foot structure for a hi-hat cymbal includes a base, a stand and a movable foot pivotally engaging with the base and stand. The base has two protrusive stubs located at two sides. The movable foot has one end pivotally engaged with a tube sleeve and another end engaged with the stub through a linkage means such that the movable foot may be turned about the tube through the tube sleeve. The movable foot may be folded for storing or extended for use, and may be swiveled to the left or right side of the base to suit the needs or desire of different drummers.

4 Claims, 11 Drawing Sheets

CHANGEABLE FOOT STRUCTURE FOR HI-HAT CYMBAL

BACKGROUND OF THE INVENTION

This invention relates to a hi-hat cymbal and particularly a hi-hat cymbal that may form a dual-foot or tripod cymbal stand and which may be swiveled to left or right side for use.

Hi-hat cymbal and drums are important musical instruments in concerts and almost all kinds of musical performance occasions. FIG. 1 shows a conventional hi-hat cymbal which has a foot stand 1 equipped with a center strut 3 to support two cymbals 2 at the top end and a foot pedal 4 at the bottom. Stepping the foot pedal 4, the two cymbals 2 may be actuated to hit against each other for producing sound desired. The foot stand 1 is supported by three feet 5 which are extended around a circular perimeter to securely hold the cymbal on the floor.

The hi-hat cymbal usually has to couple with drum set at the performance sites, and it takes relatively large floor space. When performance sites are outdoors on grass field or with no even ground surface, the three feet 5 cannot stand steadily.

SUMMARY OF THE INVENTION

It is an object of this invention to provide a movable foot which is pivotally engaged with a base and the foot stand, and may be folded for storing and extended for use such that the supporting feet may be changed to suit various configurations and sites for supporting the hi-hat cymbal stand steadily, and may free more space for coupling with other musical instruments (such as double pedal, drums or the like) when in use.

Another object of this invention is to provide a movable foot pivotally engaged with a base and foot stand that may be folded for storing and extended for use whereby to couple with the drum set closely to save space.

A further object of this invention is to provide a movable foot that may be swiveled to left or right side for left-handed drummer to use comfortably.

In order to achieve aforesaid objects, this invention includes a base and a movable foot pivotally engaged with the base and a foot stand. The base has two sides each has a protrusive stub formed thereon. The movable foot has one end pivotally engaged with a tube sleeve and another end pivotally engaged with the stub through a linkage means such that the movable foot and stub may form a relative connection with a movable angle.

BRIEF DESCRIPTION OF THE DRAWINGS

The invention, as well as its many advantages, may be further understood by the following detailed description and drawings, in which.

DETAILED DESCRIPTION OF THE PREFERRED EMBODIMENT

Figure 1:
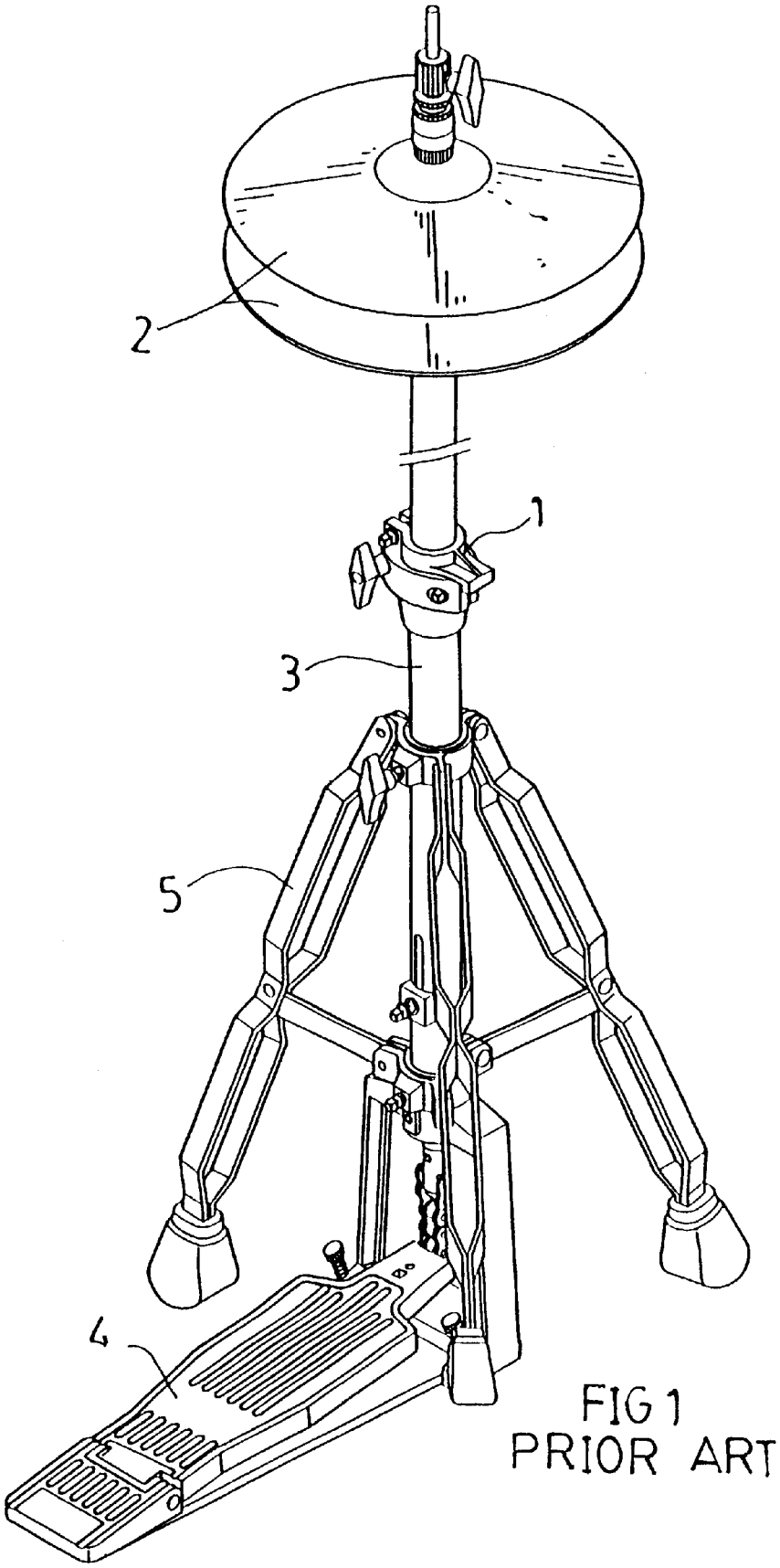
FIG 1 PRIOR ART
FIG. 1 is a perspective view of a conventional hi-hat cymbal.

Referring to FIGS. 2 through 8, this invention includes a stand 10, a base 20 located below the stand 10 and a movable foot 30 pivotally engaged with stand 10 and base 20 (shown in FIG. 6A).

The stand 10 includes a tube 13, two feet 11 pivotally engaged with the tube 13 through a stand sleeve 12 mounted on the tube 13. The stand sleeve 12 has an adjust screw bolt 14 for securely holding the stand sleeve 12 on the tube 13. The adjust screw bolt 14 forms respectively a same selected angle with each of the two feet 11 (shown in FIG. 6A).

Figure 2:
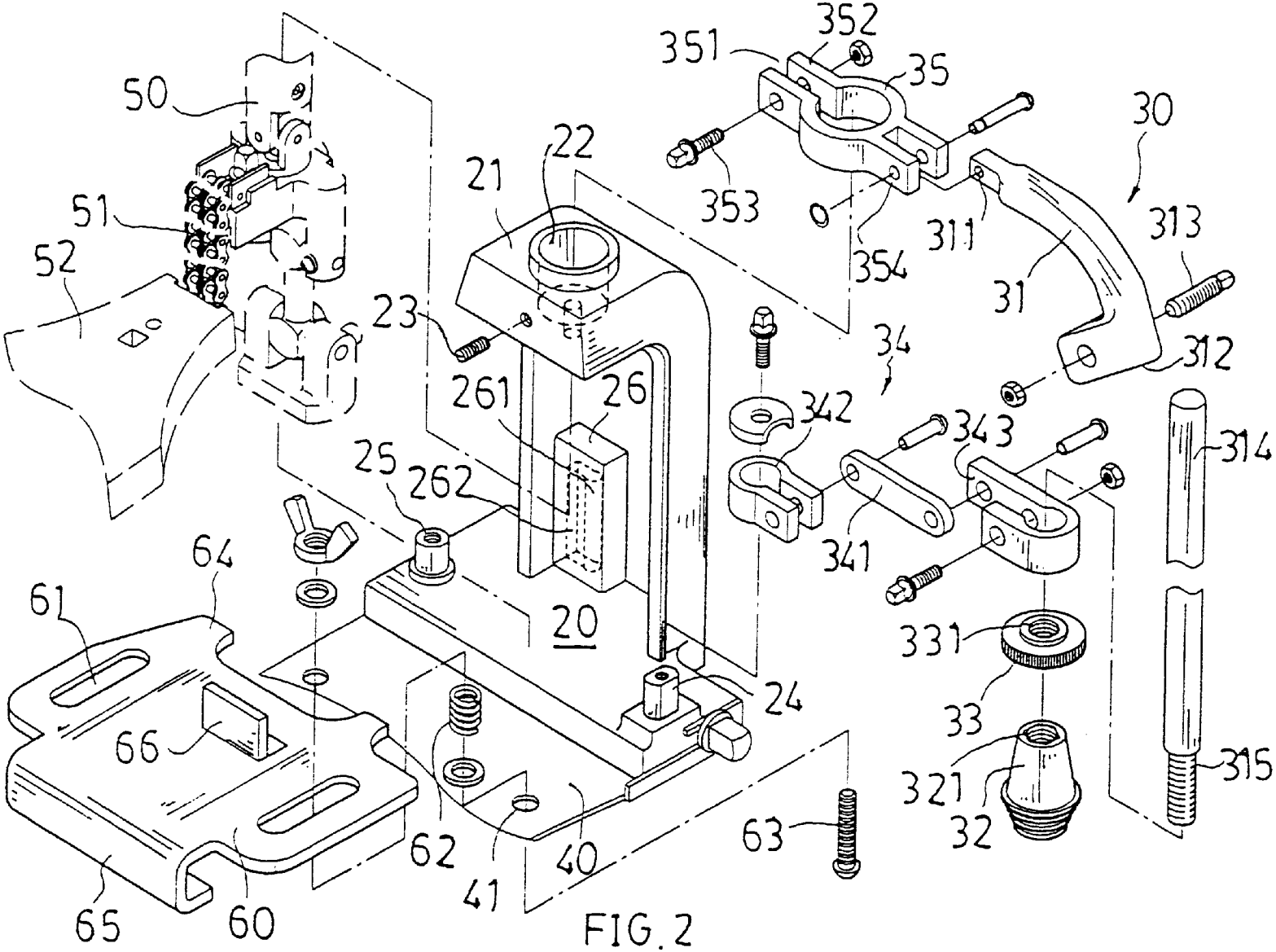
FIG. 2 is an exploded view of this invention.
Figure 3:
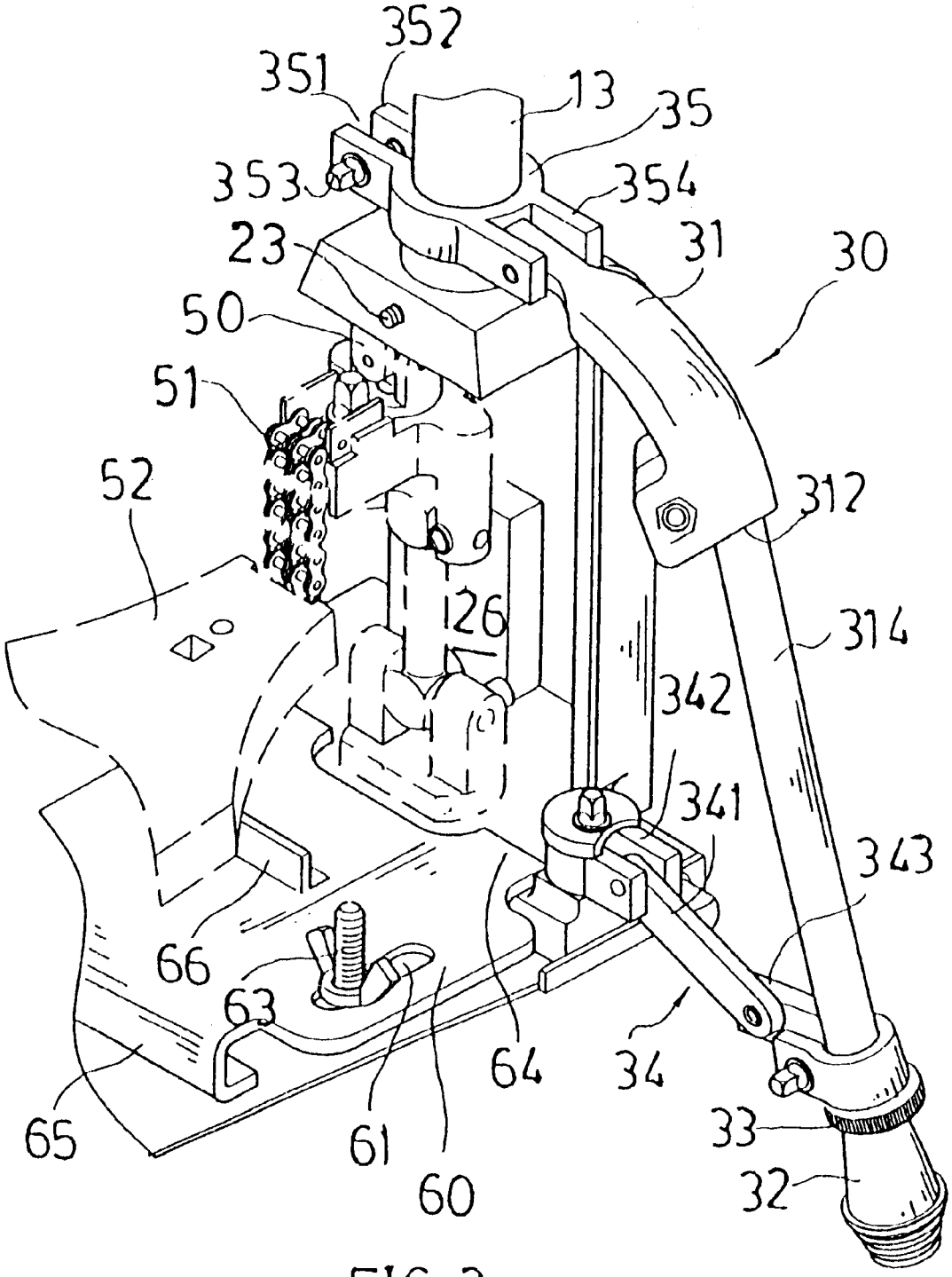
FIG. 3 is a perspective view of this invention.

Referring to FIGS. 2 and 3, the base 20 is located below the stand 10 and engages with a foot pedal 52. The base 20 includes a frame 21 which is substantially formed in a reversed L shape. Between the base 20 and frame 21, there is a swivel block 50 which engages with the foot pedal 52 through a chain 51. Stepping the foot pedal 52, the two cymbals 2 may be driven to hit against each other for making sound. The frame 21 has a top end in which a step opening 22 is provided at the center thereof for holding the tube 13 and a center rod 15. At one side of the frame 21, there is a set screw 23 for engaging the tube 13 and center rod 15 securely in the step opening 22. The pedal 52 is fastened to the base 20 at two sides by screw bolts. At two ends of the base 20, there are respectively two protrusive stubs 24 and 25.

The movable foot 30 includes the following elements:

A rod sleeve 31 which has a through hole 311 at one end and a sleeve opening 312 at another end which in turn has a screw bolt 313 adjacent thereof. The sleeve opening 312 is engaged with one end of a rod 314. The rod 314 has a screw section 315 formed at another end thereof The rod 314 is slidable in the rod sleeve 31 through the sleeve opening 312 (also shown in FIG. 5C).

Figure 5A:
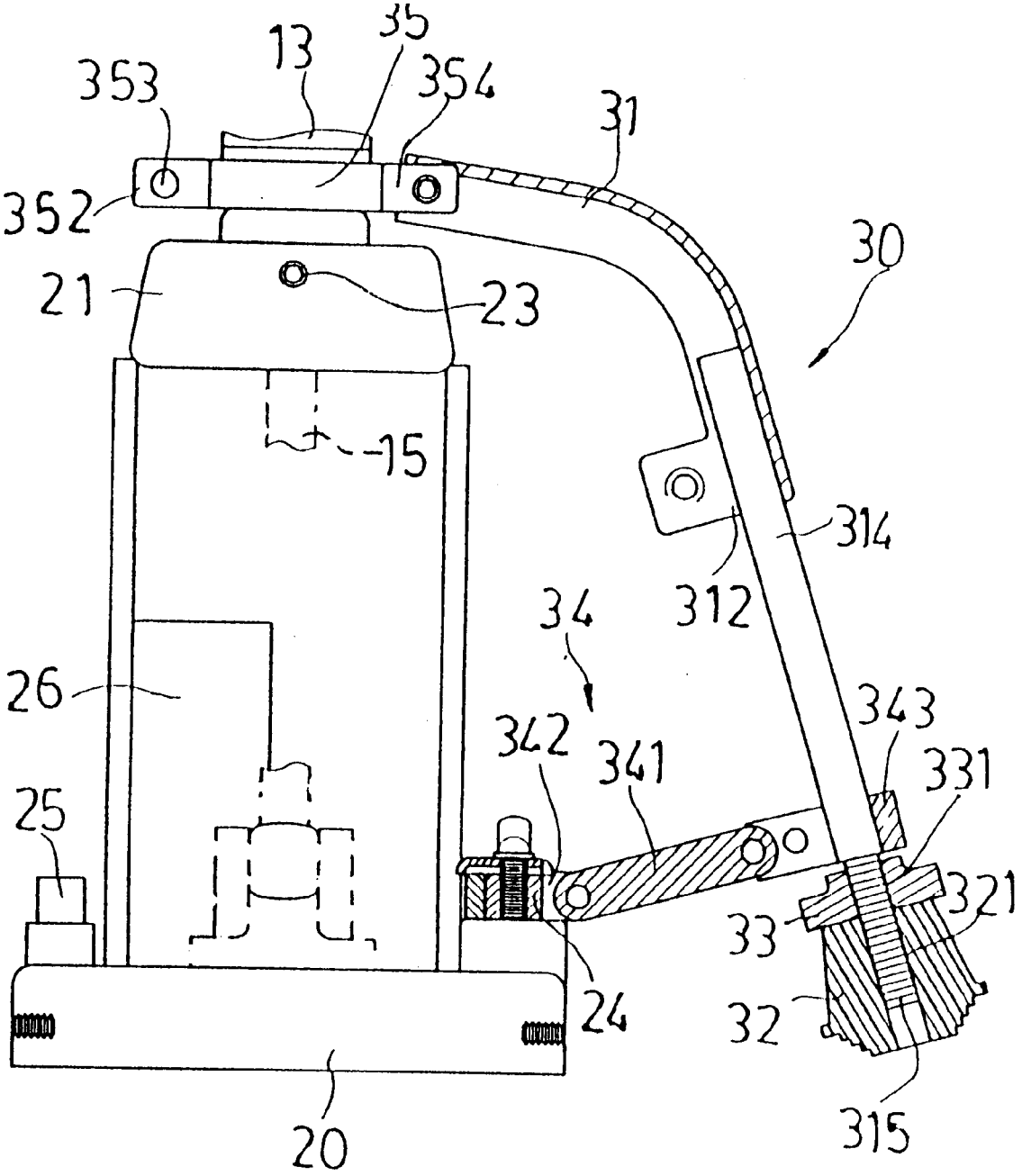
FIG. 5A is a sectional view of a linkage means of this invention.
Figure 5B:
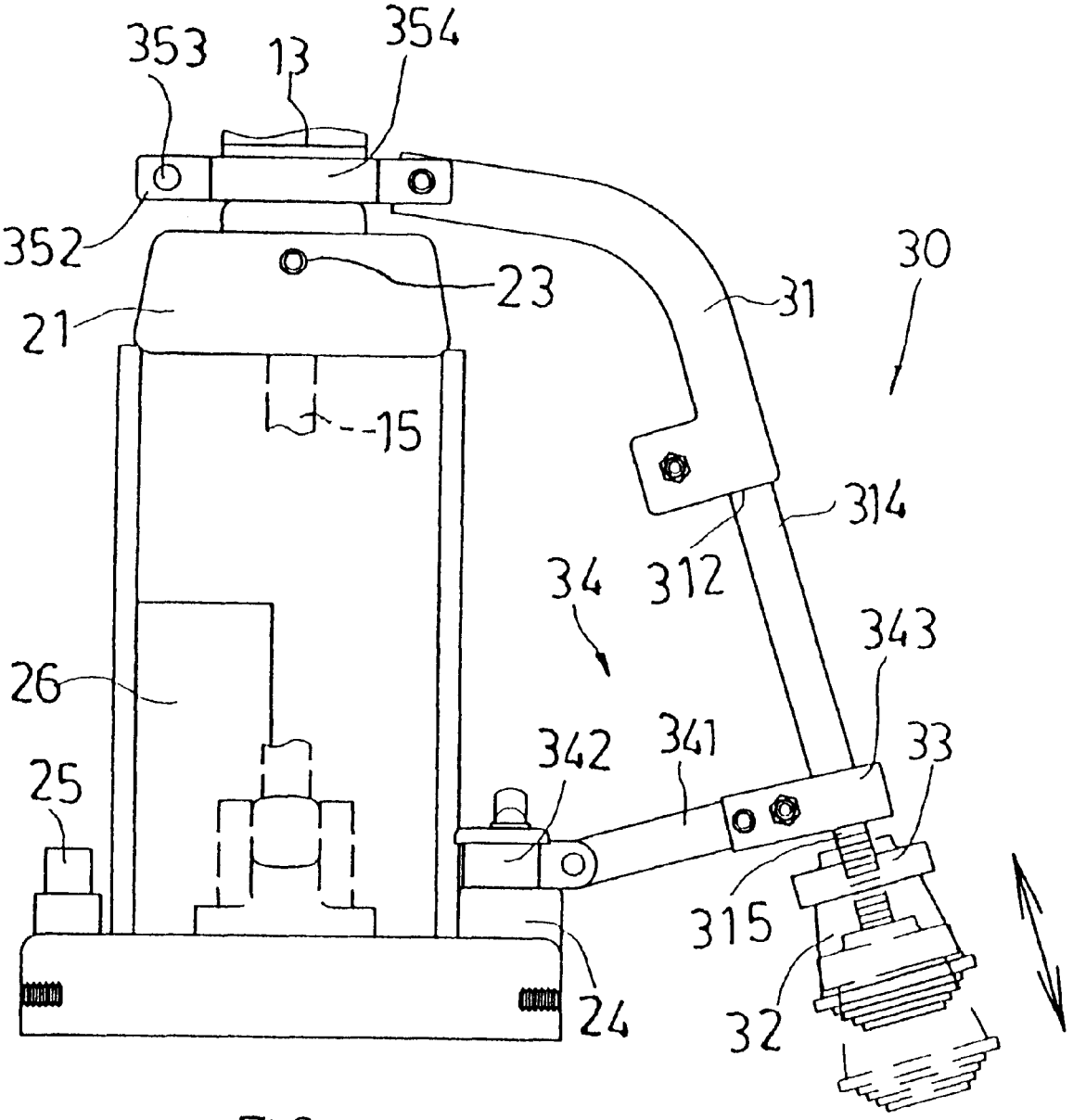
FIG. 5B is a schematic view of the linkage means shown in FIG. 5A, with the adjusting knob under adjustment.

An adjusting knob 32 which has internal screw threads 321 for engaging with the screw section 315 of the rod 314 for forming a pad of the rod 314 to prevent the movable foot 30 from wearing off on the ground (shown in FIGS. 2 and 5A).

An adjust ring 33 has a center screw bore 331 engageable with the screw section 311 for adjusting the position of the adjusting knob 32 to make contact with the ground (shown in FIGS. 2 and 5A).

A linkage means 34 includes a linkage beam 341 which has two ends pivotally engaged with a first anchor member 342 and a second anchor member 343. The first anchor member 342 may be engaged with the stub 24 or 25 while the second anchor member 343 is pivotally engaged with the rod 314. Thereby the movable foot 30 and stub 24, 25 form an angular and movable connection through the linkage means 34 (FIGS. 3 and 5A).

A tube sleeve 35 is located above the step opening 22 of the frame 21 for pivotally engaging with the tube 13. It has a slot 351 at one side between a pair of extended clamp fingers 352 which may engage with a clamp screw 353 for fastening the tube sleeve 35 tightly on the tube 13 or for loosely engaging the tube sleeve 35 on the tube 13 so that the tube sleeve 35 may be turned about the tube 13. The sleeve 35 has a pair of rod fingers 354 at another side for pivotally engaging with the through hole 311 so that the rod sleeve 31 is pivotally turnable about the rod sleeve 35 against the tube 13 (FIGS. 2 and 3).

A base plate 40 is located below the base 20 has one end pivotally engaged with one end of the pedal 52 and an aperture 41 formed at a selected location thereof.

Figure 4:
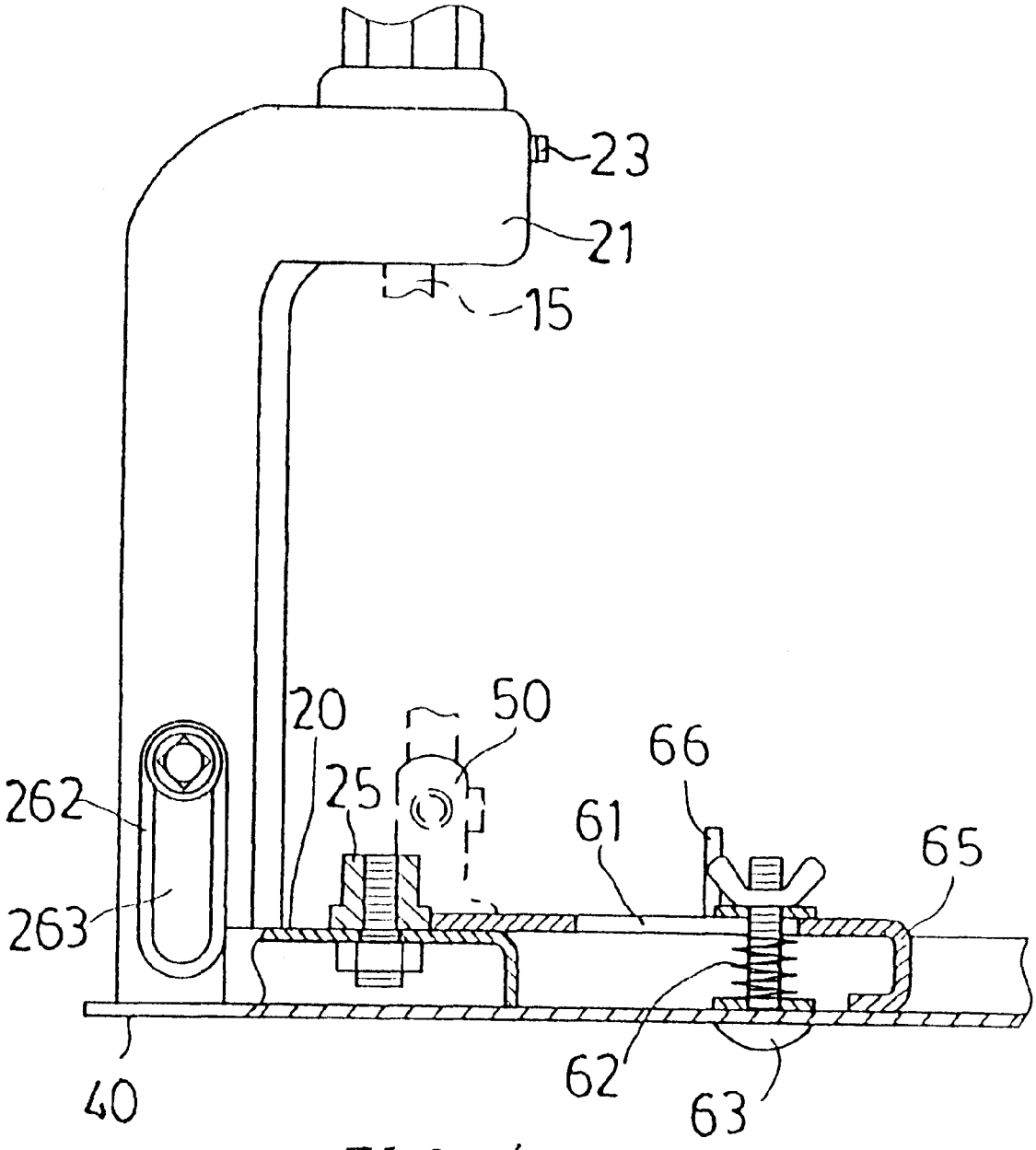
FIG. 4 is a sectional view of a base of this invention.

A clamp board 60 has two slots 61 formed at two sides for engaging with the base plate 40 through a butterfly screw 63 and a spring 62 located therebetween (referring to FIGS. 3 and 4). At one end of the clamp board 60, there are two extended clamp flanges 64 for clamping the base 20 between the base plate 40 and clamp board 60. At another end of the clamp board 60 opposite to the clamp flanges 40 is a step like end wall 65 mating the height of the base 20 (FIG. 4). There is an upward lug 66 located between the slots 61 for moving and adjusting the position of the clamp board 60.

Figure 6A:
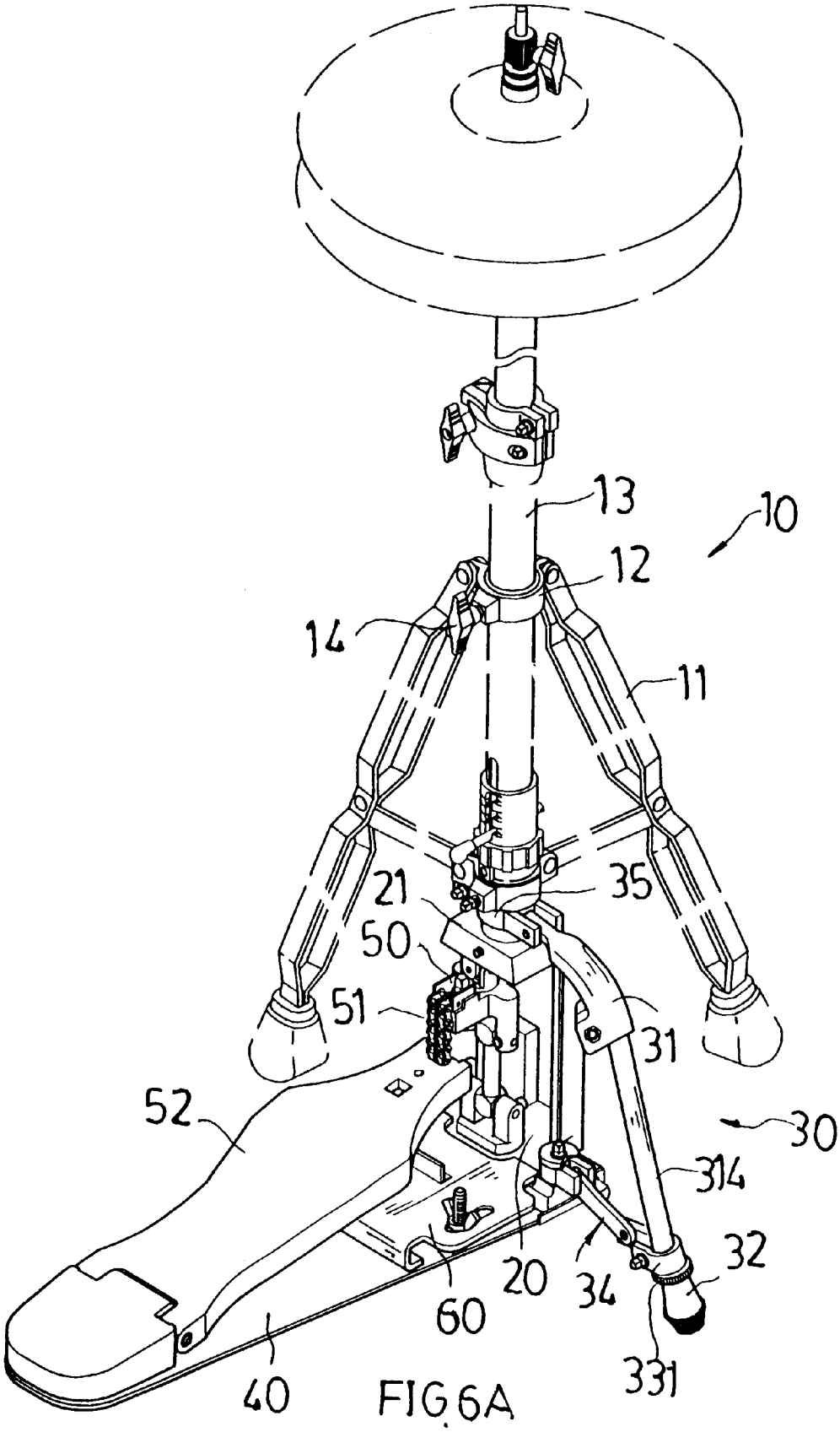
FIG. 6A is a pictorial view of this invention in use.
Figure 6B:
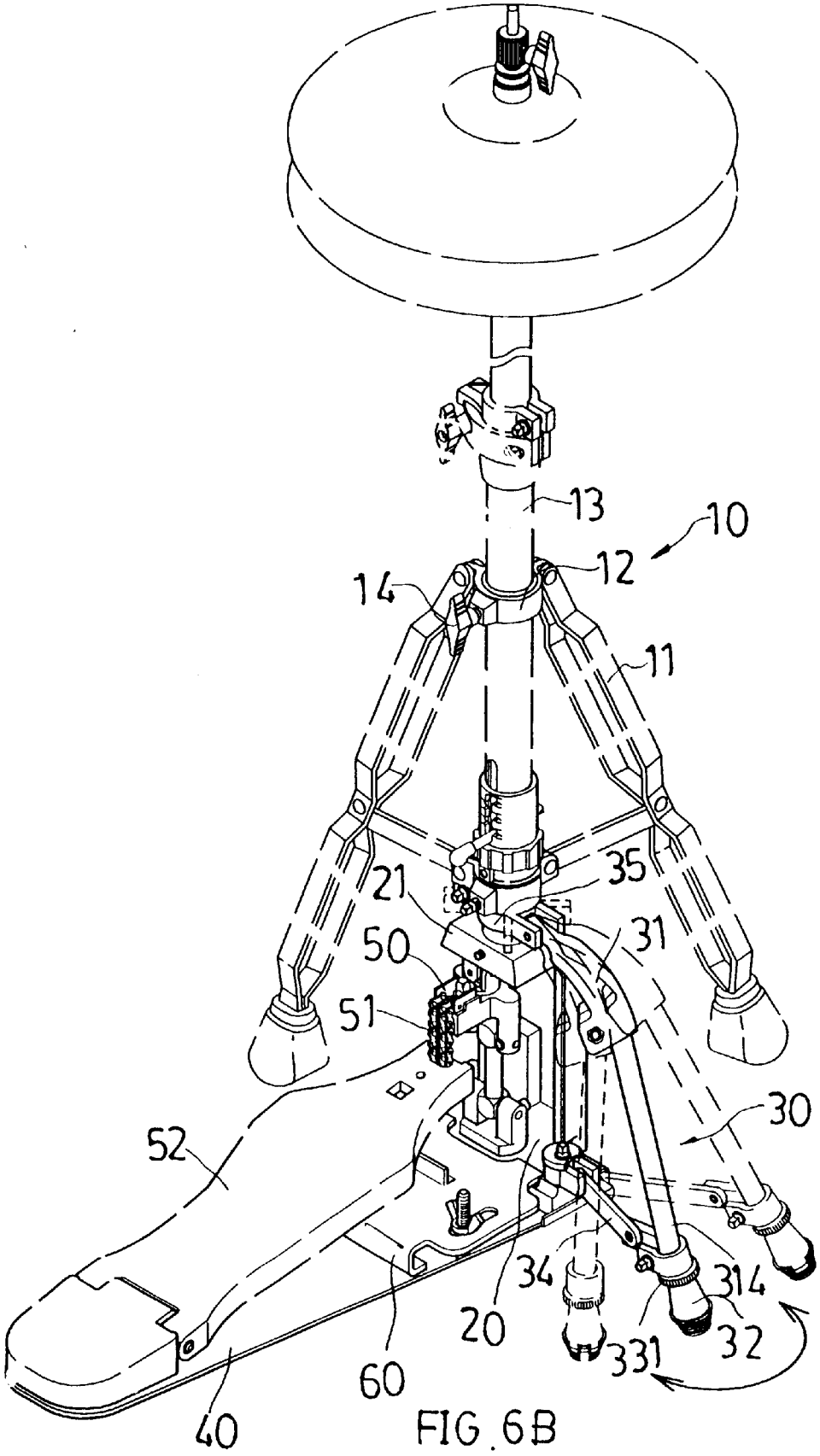
FIG. 6B is a pictorial view of this invention in use, with the movable foot in motion.
Figure 7:
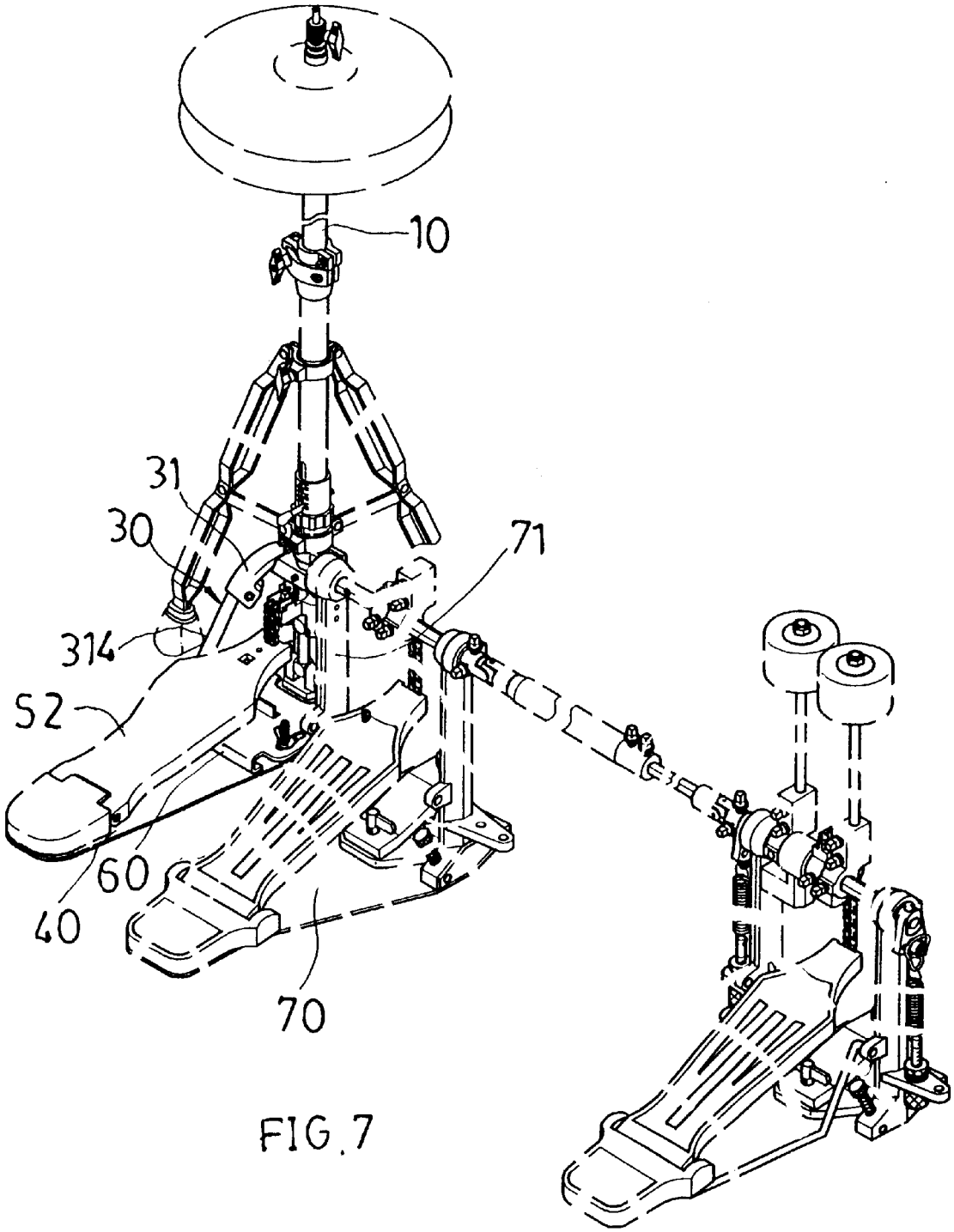
FIG. 7 is a pictorial view of this invention coupling with a double pedal.

FIGS. 2 and 3 show how this invention put together for assembly. The rod 314 has one end engaged with the sleeve opening 312 of the sleeve 31 which in turn is pivotally engaged with the tube sleeve 35. Another end of the rod 31 engages with the linkage means 34 which in turn is pivotally engaged with the stub 24. Then the movable foot 30 may be turned about the base 20. When in use, unscrew the screw bolt 353 to loosen the tube sleeve 35 for moving the movable foot 30 to a location desired (FIG. 6B). Then tightening the screw bolt 353 to make the movable foot 30 fixed and stationary. Turn the adjust ring 33 to adjust position of the adjusting knob 32 to make contact with the ground (shown in FIG. 5B).

Figure 5C:
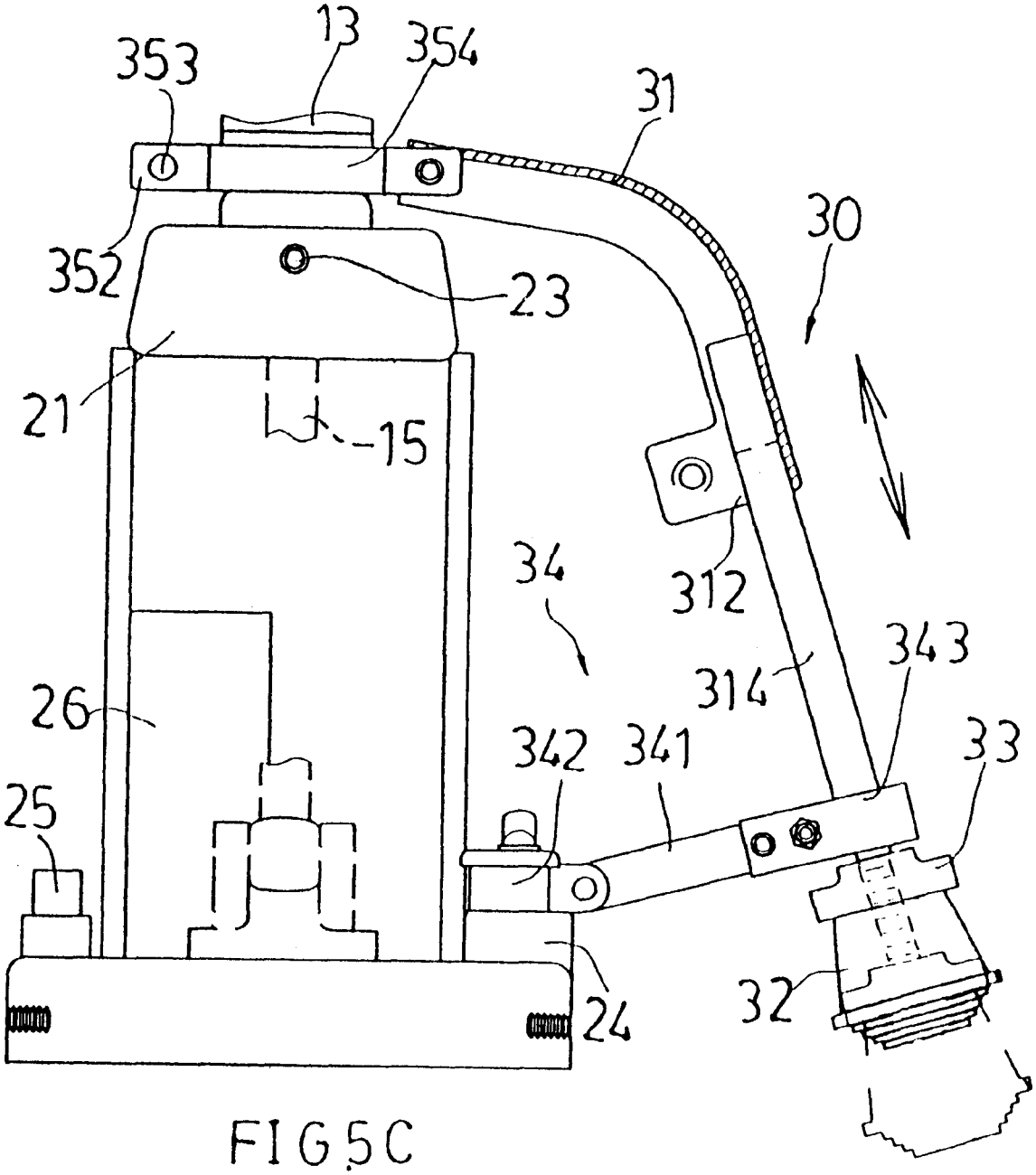
FIG. 5C is a schematic view of the movable foot under adjustment according to FIG. 5A.

If adjusting the adjust ring 33 cannot make the adjusting knob 32 touching the ground, a larger adjustment may be made at the other end of the rod 314 by changing the length of the rod 314 held in the rod sleeve 31 (shown in FIG. 5C).

There are occasions when adding a double pedal is desired beside a hi-hat cymbal. However the limited space available at the performance sites often makes such an arrangement difficult. This invention may help to solve such a problem. By unscrewing the screw bolt 353 to loosen the tube sleeve 35, the movable foot 30 may be folded and withdrawn to one side of the frame 21. Then tighten the screw bolt 353 again to make the movable foot 30 stationary. The hi-hat cymbal still has three feet to stand firmly but may spare space at one side for installing a double pedal 70 (shown in FIG. 7). This may greatly enhance the fiction and usefulness.

The two stubs 24 and 25 located at two sides of the base 20 may engage with the linkage means 34 at either side desired, and enable the movable foot 30 located at either side accordingly. This also increase the flexibility of arrangement of the hi-hat cymbal.

Referring to FIG. 4, the clamp board 60 and base plate 40 clamp the base 20 therebetween by means of the butterfly screw 63 to serve as an extension of the base 20 for supporting the hi-hat cymbal more steadily. Loosen the butterfly screw 63 may disengage the base 20 from the clamp 60 and base plate 40. Then the clamp board 60 may be moved through gripping and moving the lug 66 for adjusting the relative clamping position of the base 20 to suit the floor space available. Once the butterfly screw 63 is tightened again, the hi-hat cymbal may stand on the floor securely.

Figure 8:
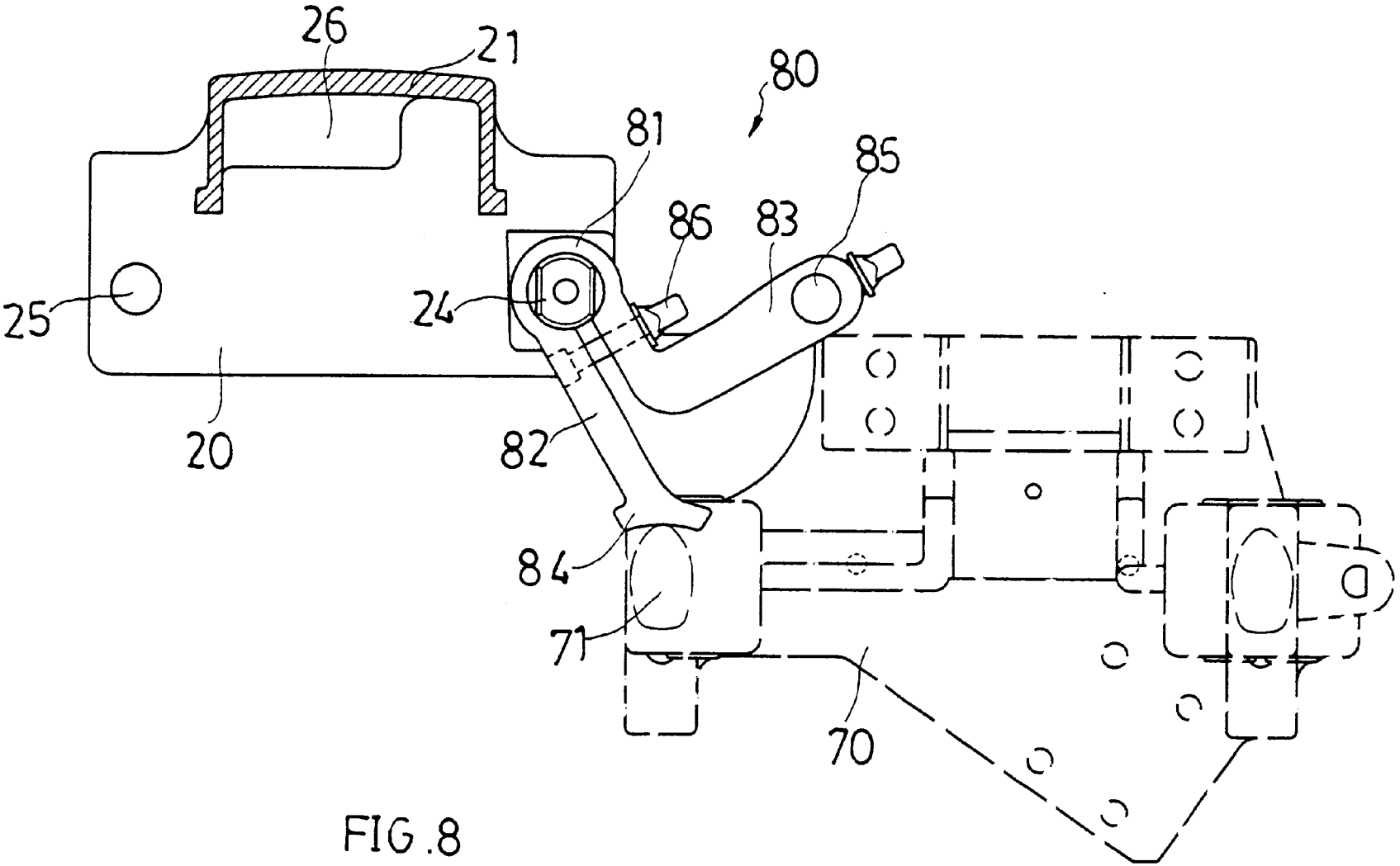
FIG. 8 is a schematic view of this invention coupling with an anchor means.

In order to make the double pedal 70 located at a distance from this invention to prevent possible interference among users, the stub 24 may further engage with an anchor means 80 (shown in FIG. 8). The anchor means 80 includes an anchor ring 81 for engaging with the stub 24 and a straight bar 82 and a crooked bar 83 extended respectively from two sides of the anchor ring 81. The straight bar 82 and crooked bar 83 are spaced from each other and is turnable about the anchor ring 81 and stub 24 to an angle desired when a set screw 86 is turned loose, and may be fastened tightly on the stub 24 by means of the set screw 86 once the bars 82 and 83 are turned to positions desired. The straight bar 82 has a free end formed a step end 84 for anchoring on a connection rod 71 of the double pedal 70. The crooked bar 83 also has a free end fastened with an anchor strut 85 to lay on the ground for making the anchor means 80 steady and balanced.

What is claimed is:

1. A changeable foot structure for a hi-hat cymbal, comprising:

a stand including a tube, a stand sleeve pivotally engaged with the tube and two feet each having one end pivotally engaged with the stand sleeve;

a base having a frame located thereon and extended upward, a swivel block located between the base and frame, and two protrusive stubs located respectively at two sides, the frame having a step opening formed in an upper end in the center and a set screw at a selected location in a side wall thereof; and a movable foot pivotally engaged with the base and stand including:

a rod sleeve having a through hole formed at one end and an sleeve opening at another end for engaging with a rod which has a screw section at one end thereof, an adjusting knob having internal screw threads engageable with the screw section, an adjust ring having a center screw bore engageable with the screw section, a linkage means having a linkage beam which has one end pivotally engaged with one of a first anchor member for engaging with the stub of the base and another end pivotally engaged with a second anchor member for pivotally engaging with the rod; and a tube sleeve located above the step opening having an opening pivotally engaging with the tube, a pair of clamp fingers extended from one side of the opening fastenable by a clamp screw and a pair of rod fingers extended from another side of the opening for pivotally engaging with the through hole of the rod.

2. The changeable foot structure according to claim 1, wherein the stand sleeve has only two spots engaging with the two feet and an adjust screw bolt.

3. The changeable foot structure according to claim 1 further having a base plate below the base and a clamp board above the base, the base plate having two apertures formed at selected locations, the clamp board having two slots formed at two sides thereof for engaging with the base plate through a butterfly screw and the aperture, two protrusive clamp flanges located at one side thereof, a step end wall which has substantially same thickness as the base, and an upward lug located between the slots.

4. The changeable foot structure according to claim 1 further having an anchor means engaged with the stub, the anchor means has an anchor ring and a straight bar and a crooked bar extended outward, the straight bar has a step end formed at one end thereof, the crooked bar has one end engaged with an anchor strut.

* * * * *